US005855495A

United States Patent [19]

Kubo

[11] Patent Number: 5,855,495

[45] Date of Patent: Jan. 5, 1999

[54] EXHAUST GAS CLEANING DEVICE OF OUTBOARD MOTOR UNIT

[75] Inventor: Osamu Kubo, Hamamatsu, Japan

[73] Assignee: Suzuki Kabushiki Kaisha, Japan

[21] Appl. No.: 684,861

[22] Filed: Jul. 25, 1996

[30] Foreign Application Priority Data

Jul. 31, 1995 [JP] Japan ..... 7-195579

[51] Int. Cl.[6] ..... B63H 21/38

[52] U.S. Cl. ..... 440/89; 60/299

[58] Field of Search ..... 440/89, 88; 60/299, 60/302, 314, 322, 312, 313

[56] References Cited

U.S. PATENT DOCUMENTS

| | | | |
|---|---|---|---|
| 3,692,006 | 9/1972 | Miller et al. | 440/89 |
| 4,951,465 | 8/1990 | Torigai | 440/89 |
| 5,346,417 | 9/1994 | Isogawa | 60/302 |
| 5,378,180 | 1/1995 | Nakayama et al. | 440/89 |

FOREIGN PATENT DOCUMENTS

| | | | |
|---|---|---|---|
| 4301286 | 7/1993 | Germany | 440/89 |
| 404159414 | 6/1992 | Japan | 60/299 |

*Primary Examiner*—Sherman Basinger
*Attorney, Agent, or Firm*—Ronald P. Kananen

[57] ABSTRACT

An exhaust gas cleaning device is provided for an outboard motor unit having an engine provided with a pair of cylinder rows arranged so as to provide a V-shape and a crank shaft arranged substantially in a perpendicular direction in a using state and having an exhaust expansion chamber on a side of a cylinder head of the engine. In the improvement, a catalyst is disposed below the engine and inside a space having substantially a triangle shape, in a plan view, defined by a central line of one of the cylinder rows, a central line of another one of the cylinder rows and a central line of the expansion exhaust chamber. The catalyst is also disposed, in an arrangement of the cylinder rows providing a V-shape having an angle of less than 90°, below the engine and inside a space having substantially a triangle shape, in a plan view, defined by an inner wall section of one of the cylinder rows, an inner wall section of another one of the cylinder rows and a wall section, facing the V-shape section of the cylinder rows, of the expansion exhaust chamber.

3 Claims, 2 Drawing Sheets

EXHAUST GAS CLEANING DEVICE OF OUTBOARD MOTOR UNIT

BACKGROUND OF THE INVENTION

The present invention relates to an exhaust gas cleaning device of an outboard motor unit.

Recently, in order to prevent air contamination and water contamination, a catalyst is disposed in an exhaust passage of an outboard motor unit. Attention is paid to the location of the catalyst because the catalyst is degraded or damaged if in contact with a water component such as sea water.

In one example of a conventional outboard motor unit considering the above problem, an exhaust expansion chamber is disposed below an engine, a first exhaust passage opened to the expansion chamber is disposed, a second exhaust passage is also disposed so as to communicate the expansion chamber with an underwater exhaust port, and a counterflow preventing section is provided on the way of the second exhaust passage. The counterflow preventing section is positioned above a body of a hull to which the outboard motor unit is mounted.

However, in the conventional structure mentioned above, because the counterflow preventing section is formed by bending the exhaust passage, an exhaust resistance is increased, resulting in the lowering of an output power of the engine.

SUMMARY OF THE INVENTION

An object of the present invention is to substantially eliminate the problems or defects mentioned above and to provide an exhaust gas cleaning device of an outboard motor unit capable of reducing an exhaust resistance with an exhaust passage having a less bent structure.

Another object of the present invention is to provide an exhaust gas cleaning device of an outboard motor unit making easy a layout of the exhaust passage in the outboard motor unit.

These and other objects of the present invention can be achieved by providing an exhaust gas cleaning device of an outboard motor unit having an engine provided with a pair of cylinder rows arranged so as to provide a V-shape and a crank shaft arranged substantially in a perpendicular direction in a using state and having an exhaust expansion chamber on a side of a cylinder head of the engine, in the improvement wherein, a catalyst means is disposed below the engine and inside a space having substantially a triangular shape, in a plan view, defined by a central line of one of the cylinder rows, a central line of another one of the cylinder rows and a central line of the expansion exhaust chamber. The catalyst is also disposed, in an arrangement of the cylinder rows providing a V-shape having an angle of less than 90°, below the engine and inside a space having substantially a triangular shape, in a plan view, defined by an inner wall section of one of the cylinder rows, an inner wall section of another one of the cylinder rows and a wall section, facing the V-shape section of the cylinder rows, of the expansion exhaust chamber.

An exhaust port is disposed on outer wall sections of the cylinder rows, respectively, which are covered by exhaust gas collection covers.

According to the present invention, the catalyst means is disposed at a portion inside a triangle defined as mentioned above, so that the length of the exhaust passage connecting a first exhaust expansion chamber, the catalyst and a second exhaust expansion chamber can be made short, thus reducing the exhaust resistance.

Furthermore, at the time of engine operation stopping or idling, water such as sea water fills partially the first exhaust passage and at the time of rapid engine speed reduction, the sea water is raised up to the first exhaust passage by means of the negative pressure caused in the exhaust passage. However, since a fourth exhaust tube and the catalyst at the upper end of the first exhaust passage are not directly contacted, the sea water never contacts the catalyst means.

Still furthermore, according to the arrangement in which the exhaust port is positioned outside the V-bank of the cylinder rows, a space having a sufficient area is formed to the inner lower portion of the triangular shape, whereby the layout or arrangement of the first exhaust expansion chamber and the catalyst means as well as the exhaust passage can be easily done.

The nature and further characteristic features of the present invention will be made more clear from the following descriptions made with reference to the accompanying drawings.

DESCRIPTION OF THE PREFERRED EMBODIMENT

Figure 1:
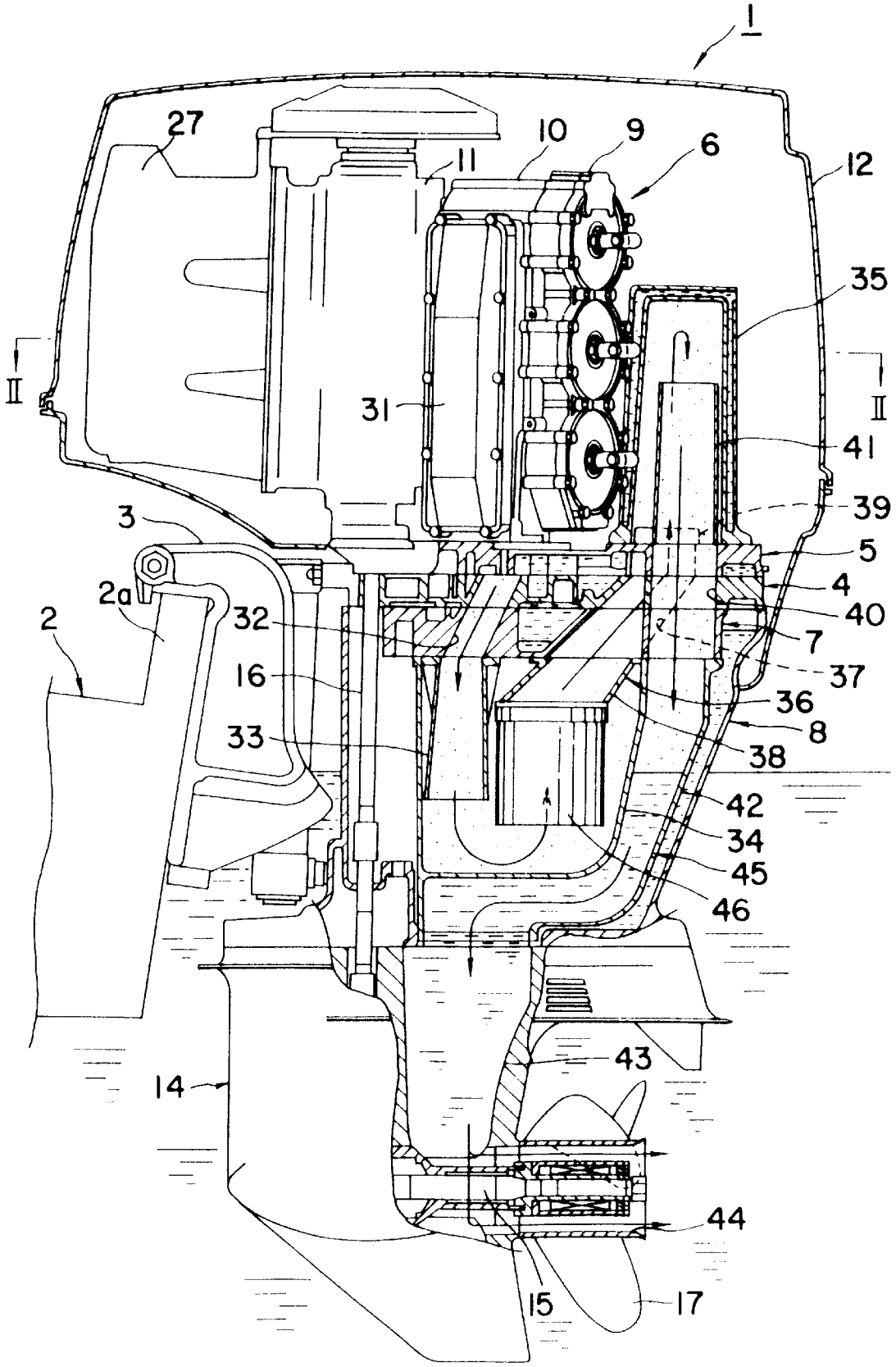
FIG. 1 is an elevational section of an outboard motor unit according to one embodiment of the present invention.

With reference to FIG. 1, an outboard motor unit 1 according to the embodiment of the present invention is mounted to a transom 2*a* of a hull 2 through a bracket 3. The outboard motor unit 1 is equipped with an engine holder 4 connected to the bracket 3. An engine 6 is disposed above the engine holder 4 through an oil seal housing 5 and a drive shaft housing 8 is also disposed below the engine holder 4 through an exhaust manifold 7.

Figure 2:
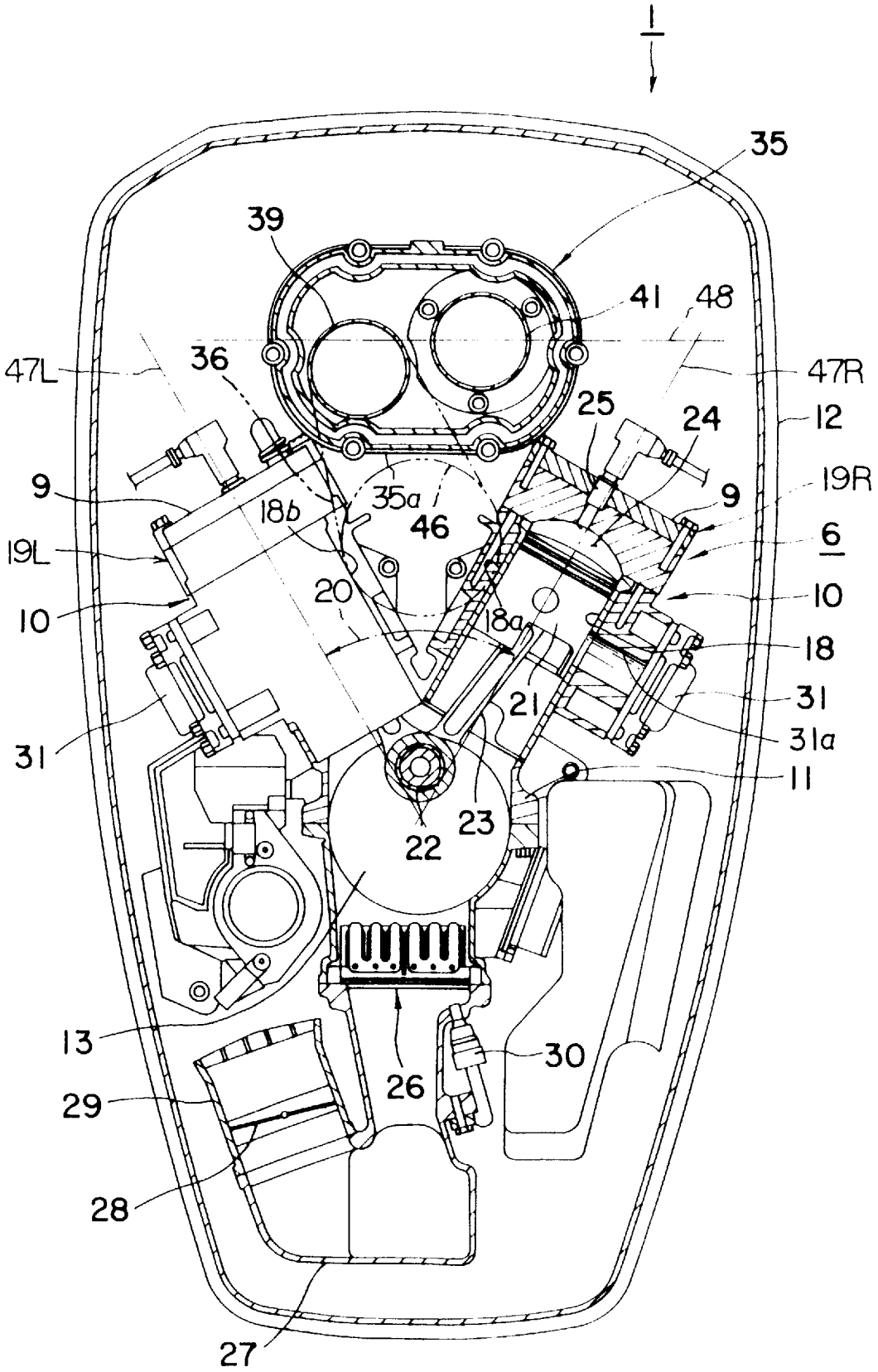
FIG. 2 is a sectional view taken along the line II—II in FIG. 1.

As shown in FIGS. 1 and 2, the engine 6 is for example a water cooled two-stroke-cycle V-type six-cylinder engine, which is composed of a cylinder head 9, a cylinder block 10, a crank case 11, and so forth. The engine 6 is covered by an engine cover 12, and a crank shaft 13 is mounted perpendicularly as viewed in the crank case 11 to be rotatable.

A gear case 14 is disposed below the drive shaft housing 8 and a propeller shaft 15 driven by the engine 6 is supported to be rotatable. The rotation of the engine 6 is transmitted to the propeller shaft 15 through a drive shaft 16 connected to the crank shaft 13 and a bevel gear, not shown, to thereby drive a propeller 17 supported to a rear end of the propeller shaft 15.

In the cylinder block 10, a cylinder assembly 18 is disposed, and the cylinder assembly 18 is composed of a pair of cylinder rows including a righthand row of three cylinders 19R and a lefthand row of three cylinders 19L, as viewed in FIG. 2, which are disposed in series to form a V-shape. In this embodiment, a narrow angle, that is a V-bank 20 between the righthand and lefthand rows of the cylinders 19R and 19L is set to less than 20°.

Pistons 21 are fitted into the respective cylinders of the cylinder assembly 18 and the pistons 21 are connected to crank pins 22 of the crank shaft 13 through connection rods 23 in a manner that reciprocal strokes of the pistons 21 are converted to rotational motion of the crank shaft 13. A combustion chamber 24 is formed to a connection portion between the cylinder head 9 and the cylinder block 10, and an ignition plug 25 is screwed to a central portion of the combustion chamber from the outside thereof.

A lead valve unit 26 as a suction valve unit is disposed in the crank case 11. A surge tank 27 is disposed on the upstream side of the lead valve unit 26 and a suction tube 29 provided with a throttle 28 is also connected to a further upstream side thereof. In the surge tank 27, a fuel injector 30 is mounted from an external side so as to jet a fuel towards the upstream side of the lead valve unit 26.

Exhaust ports 31*a* are formed to the inner peripheral surfaces of the respective cylinders at portions outside the V-bank 20, and these exhaust ports are covered by an exhaust gas collecting cover 31, which serves to converge the exhaust gas exhausted through the respective cylinders. The lower portion of the exhaust gas collecting cover 31 is communicated with a first exhaust hole, i.e. passage, 32 formed vertically through an oil seal housing 5, the engine holder 4 and the exhaust manifold 7 and with a first exhaust tube 33 connected to the first exhaust hole 32.

A first exhaust expansion chamber 34 is formed to the lower portion of the exhaust manifold 7 in the drive shaft housing 8, and in the expansion chamber 34, the first exhaust tube 33 is disposed so as to extend vertically as viewed. A second exhaust chamber 35 is also formed to the upper portion of the oil seal housing 5 on the rear side of the cylinder head 9 of the engine 6 with respect to the advancing direction of the hull 2. These first and second exhaust expansion chambers 34 and 35 are communicated with each other through a communication passage 36 formed substantially vertically. The communication passage 36 is composed of a communication hole 37 formed through the oil seal housing 5, the engine holder 4 and the exhaust manifold 7, a second exhaust tube 38 connected to the communication hole 37 and disposed in the first exhaust expansion chamber 34, and a third exhaust tube 39 connected to the communication hole 37 and disposed in the second exhaust expansion chamber 35.

The oil housing 5, the engine holder 4 and the exhaust manifold 7 are formed with a second exhaust hole 40 adjacent to the communication hole 37 in a vertical fashion as viewed. A fourth exhaust tube 41 is arranged inside the second exhaust expansion chamber 35 above the second exhaust hole 40 in a vertical fashion and connected thereto, and a first exhaust passage 42 is disposed below the second exhaust hole 40 in an integral manner or separate manner with respect to the first exhaust expansion chamber 34. The first exhaust passage 42 has an outlet side end connected to a second exhaust passage 43 formed in the gear case 14. The second exhaust passage 43 extends into water through an exhaust gas discharge passage 44 formed around the propeller shaft 15. As mentioned above, according to this embodiment, the exhaust passage structure 45 is composed of the first exhaust hole 32, the first exhaust tube 33, the communication passage 36 (including the communication hole 37 and the second and third exhaust tubes 38 and 39), the fourth exhaust tube 41, the second exhaust hole 40, the first exhaust passage 42, the second exhaust passage 43 and the exhaust gas discharge passage 44.

In the arrangement of the outboard motor unit of the structure described above, a catalyst means 46 is disposed at an opening portion on the side of the first exhaust expansion chamber 34 of the communication passage 36, i.e. at a portion below the second exhaust tube 38. The catalyst means 46 is disposed as shown in FIG. 2 in a portion inside a triangle defined by a central line 47R of the righthand cylinder row 19R, a central line 47L of the lefthand cylinder row 19L and a central line 48 of the second exhaust expansion chamber 35, and preferably, in a portion inside a triangle defined by cylinder wall sections 18*a*, 18*b* of righthand and lefthand cylinder rows facing the V-bank 20 side and the second exhaust expansion chamber wall 35*a* facing the V-bank 20 side.

The embodiment of the structure described above will operate as follows.

The exhaust gas discharged from the respective cylinders of the cylinder assembly 18 of the engine 6 is once converged and collected by the exhaust gas collection cover 31, and then, guided to the first exhaust expansion chamber 34 by way of the first exhaust hole 32 and the first exhaust tube 33. The exhaust gas guided to the first exhaust expansion chamber 34 is cleaned by passing through the catalyst 46, and then, guided to the second exhaust expansion chamber 35 by way of the communication passage 36. The exhaust gas is thereafter discharged from the second exhaust expansion chamber 35 into water through the fourth exhaust tube 41, the second exhaust hole 40, the first exhaust passage 42, the second exhaust passage 43 and the exhaust gas discharge passage 44.

According to the present invention, the catalyst means 46 is disposed at a portion inside a triangle defined by a central line 47R of the righthand cylinder row 19R, a central line 47L of the lefthand cylinder row 19L and a central line 48 of the second exhaust expansion chamber 35, and preferably, in a portion inside a triangle defined by the cylinder wall sections 18*a*, 18*b* of the righthand and lefthand cylinder rows facing the V-bank 20 side and the second exhaust expansion chamber wall 35*a* facing the V-bank 20 side, so that the length of the exhaust passage connecting the first exhaust expansion chamber 34, the catalyst 46 and the second exhaust expansion chamber 35 can be made short, thus reducing the exhaust resistance.

Furthermore, at the time of engine operation stopping or idling, water such as sea water fills partially the first exhaust passage 42 as shown in FIG. 1, and at the time of rapid engine speed reduction, the sea water is raised up to the first exhaust passage 42 by means of the negative pressure caused in the exhaust passage 45. However, since the fourth exhaust tube 41 and the upper end of the first exhaust passage 42 are not directly contacted, the sea water never contacts the catalyst means 46.

Still further, according to the arrangement in which the exhaust port is positioned outside the V-bank 20 of the cylinder rows 19R and 19L, a space having a sufficient area is formed to the inner lower portion of the triangle shape defined by the central line 47R of the righthand cylinder row 19R, the central line 47L of the lefthand cylinder row 19L and the central line 48 of the second exhaust expansion chamber 35, whereby the layout or arrangement of the first exhaust expansion chamber 34 and the catalyst means 46 as well as the exhaust passage 45 can be easily done.

What is claimed is:

1. In an exhaust gas cleaning device of an outboard motor unit having an engine provided with a pair of cylinder rows arranged so as to provide a V-shape and a crank shaft arranged substantially in a perpendicular direction in a using state and having an exhaust expansion chamber on a side of a cylinder head of the engine, the improvement in which a catalyst is disposed below the engine and inside a space having substantially a triangle shape, in a plan view, defined by a central line of one of the cylinder rows, a central line of another one of the cylinder rows, and a central line of the expansion exhaust chamber.

2. In an exhaust gas cleaning device of an outboard motor unit having an engine provided with a pair of cylinder rows arranged so as to provide a V-shape having an angle of less than 90° and a crank shaft arranged substantially in a perpendicular direction in a using state and having an exhaust expansion chamber on a side of a cylinder head of the engine, the improvement in which a catalyst means is disposed below the engine and inside a space having substantially a triangular shape, in a plan view, defined by an inner wall section of one of the cylinder rows, an inner wall section of another one of the cylinder rows and a wall section, facing the V-shape section of the cylinder rows, of the expansion exhaust chamber.

3. An exhaust gas cleaning device according to claim 2, wherein an exhaust port is disposed on outer wall sections of the cylinder rows, respectively, which are covered by exhaust gas collection covers.

* * * * *